US006592667B1

(12) United States Patent
Fritzson

(10) Patent No.: US 6,592,667 B1
(45) Date of Patent: Jul. 15, 2003

(54) APPLICATOR

(75) Inventor: Joachim Fritzson, Göteborg (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/857,321

(22) PCT Filed: Dec. 2, 1999

(86) PCT No.: PCT/EP99/09424

§ 371 (c)(1),
(2), (4) Date: Aug. 30, 2001

(87) PCT Pub. No.: WO00/34168

PCT Pub. Date: Jun. 15, 2000

(30) Foreign Application Priority Data

Dec. 4, 1998 (DE) ..... 198 56 086

(51) Int. Cl.[7] ..... B05C 1/06
(52) U.S. Cl. ..... 118/260; 118/261; 118/234
(58) Field of Search ..... 118/260, 261, 118/234, DIG. 20; 427/428

(56) References Cited

U.S. PATENT DOCUMENTS 1,953,863 A 4/1934 Morrell
3,507,250 A * 4/1970 Dew, Jr. ..... 118/234
4,338,975 A 7/1982 Porter
4,540,610 A * 9/1985 Conklin et al. ..... 427/434.5
5,002,098 A 3/1991 Desmet et al.
5,520,732 A 5/1996 Sarfati

FOREIGN PATENT DOCUMENTS

| | | |
|---|---|---|
| EP | 0 340 746 | 11/1989 |
| EP | 0 619 262 | 10/1994 |
| JP | 60-167941 | 8/1985 |

* cited by examiner

*Primary Examiner*—Laura Edwards
(74) *Attorney, Agent, or Firm*—Flynn, Thiel, Boutell & Tanis, P.C.

(57) ABSTRACT

An applicator for applying a liquid impregnation agent to running yarns, especially a yarn oiler. The applicator has a rotating element with a surface with which at least one transfer mechanism comes into contact, and is equipped with an integrated cleaning device for impurities which collect between the applicator element and the transfer mechanism. The cleaning device is active when the applicator is in operation.

23 Claims, 2 Drawing Sheets

Figure 1:
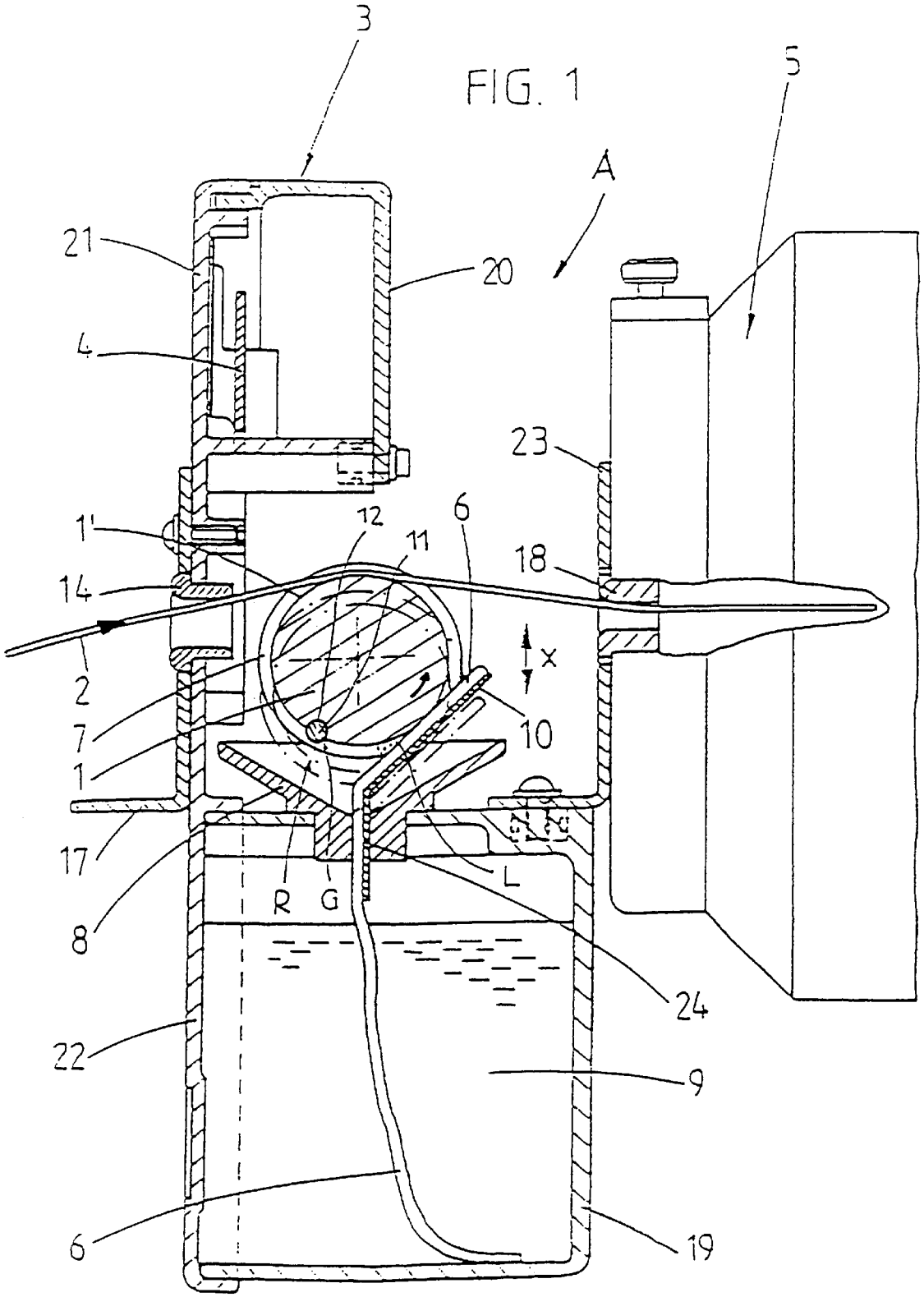

3
5
A
21
20
4
23
1'
12
11
6
18
14
2
7
1
x
10
17
8
R
G
L
24
22
9
6
19

APPLICATOR

FIELD OF THE INVENTION

The invention relates to an applicator for applying a liquid impregnation agent to running yarns.

BACKGROUND OF THE INVENTION

In an applicator known from EP 0 619 262 a leaf spring is responsible for the permanent contact by which a wick is pressed in the contact area against the surface of the applicator element, particularly independent from the current height adjustment of the applicator element, the height position of which can be varied in order to vary the wrapping angle of the yarn. The surface of the applicator element is smooth. During its rotation, contaminants such as fiber parts of the yarn, dust and the like are stripped off from the surface. During operation of the applicator unavoidable flying lint is also collected there, such that finally at the entrance of the contact area gradually a large pad of impurities is formed which shows a significant absorbing effect. Impregnating agent conveyed by the transfer member into the contact area increasingly is absorbed by the capillary effect of said pad, resulting in an uncontrollable, strong impregnation consumption and a fading wetting of the surface which in the worst case even runs dry.

From EP 0 080 843 A a device for lubricating yarn material is known in which a transfer roller directly running in a lubrication liquid bath has chevron-like grooves at its surface. Said chevron-shaped grooves serve to uniformly distribute the lubricant over the surface of the transfer roller and to uniformly apply the lubricant to the yarn. Impurities originating from the yarn material and flying lint collect in the lubricant bath which quickly gets dirty. Moreover, due to the chevron-shaped grooves the yarn is impregnated only intermittently.

From DE 802 665 A a device is known for treating yarn with a liquid during spooling on a bobbin. Said device has a rotatable applicator roller in line contact with the surface of the bobbin. A liquid tank and a wick are associated with said applicator roller. A drive system controls periodical contact between the surface of the roller and said wick to prevent the wick from becoming too hot or to prevent too much liquid from being brought onto the roller in order to thereby adapt the treatment intensity to the properties of the liquid and yarn.

Further prior art related to applicators is contained in DE 41 13 339 A; DE 28 03 488 A; U.S. Pat. Nos. 3,053,222 A; 4,845,964 A; DE 540 244 A.

It is an object of the invention to improve an applicator of the kind as disclosed at the beginning such that the consumption of the liquid impregnating agent remains substantially constant and as adjusted. Furthermore, even during long operation duration uniform impregnation of the yarn material ought to be achieved. Operation disturbance by impurities ought to be prevented. By uniform low consumption a low maintenance frequency for the applicator ought to be achieved.

The above object is achieved by providing the applicator with an onboard or integrated cleaning device for impurities collecting between the transfer member and an applicator element.

The onboard or integrated cleaning device of the applicator is activated during operation of the applicator. The cleaning device then removes impurities having the tendency to increasingly collect in the contact area between the transfer member and the applicator element, and hinders in a preventive way the formation of a contamination pad which could absorb the impregnation agent. The consumption of impregnation agent remains as adjusted and uniform even for long periods of operation. The yarn is impregnated uniformly. The applicator only seldom needs maintenance. In other words the premature operation of the cleaning device suppresses the formation of an absorbing pad of critical size of lost yarn material and collected contamination in the contact area, because contamination is removed from the entrance of the contact area during the operation of the applicator.

In a preferred embodiment, the applicator is in the form of a roller and a stripper member is periodically brought in stripping engagement at the transfer member which is in the form of an elastic wick-like body, such that the stripper member has the function of a catch and conveys collected contamination out of the critical area between the body and the roller.

In a further embodiment, a lifting member serves to temporarily lift at least the body from the surface of the roller counter to the force of a spring loading the body, such that impurities are conveyed away while bonding to the surface or, alternatively, by the influence of the stripper member directly. In such cases, it may be sufficient to only lift the body a little bit or to make it at least forceless such that impurities may slip through. The lifting member may rotate with the roller so that it simultaneously serves as a catch and to lift the body. It is possible not to move the lifting member by the roller but to separate the lifting member from the roller and to let it engage from outside at the body or at the spring loading of the body.

In a further embodiment, stripper member is in the form of at least one projection protruding from the surface of the applicator element in strips to clean the critical contact area. Since this takes place at least once with each full revolution of the roller, no absorbing pad of fiber materials and impurities will be formed.

A further embodiment involves the projection being formed as a rod-like body, such as a pin or a tube embedded into the roller. In this embodiment, the roller is simple to manufacture with the pin or the tube and the rotating roller (either driven by the running yarn or by its own drive system) provides the driving energy for the projection which in turn does the cleaning work.

In an alternative embodiment, the edge region of a depression formed into the surface of the applicator element or roller serves as the stripper member. Said edge portion carries impurities away and cleans the body. The depression has the effect that the frequently somewhat elastic and compacted impurities tend to locally expand into the depression and are caught and more easily taken away by the edge region.

The projection and/or the depression in the surface of the roller is at least substantially parallel to the axis of the roller. Other geometrical configurations or orientations might be expedient as well (oblique, chevron-like, punctually, etc.). Neither the projection nor the edge region have to extend laterally across the entire surface, and it may be sufficient to only provide shorter sections thereof with interspaces. These sections even might be offset in the circumferential direction with respect to one another.

In a further embodiment, the stripper member simultaneously defines the lifting member. During the cleaning process a combination effect is achieved since the stripper member conveys contamination away like a catch while it also lifts the body at least temporarily from the surface to more easily carry impurities away.

In this case, it is expedient to use the applicator element as the rotary drive for the lifting member and/or stripper member. The cleaning device then does not need its own drive.

Alternatively, in a further embodiment a drive is provided for the lifting member and/or the stripper member for moving the respective member periodically through the contact area and to carry away impurities and/or to lift a transfer member at the same time.

For embodiments in which the lifting member and/or the stripper member is/are not driven by the roller itself, pneumatic, electric or electromagnetic drive systems may be provided which engage by suitable auxiliary assemblies at said body or at the spring which loads said body, to temporarily strip or lift.

In a further embodiment,the spring is made of magnetic material and repelling magnetic forces are employed to temporarily lift the body from the surface. The magnet is received within the roller and fulfills a lifting step during each revolution to clean the contact area and to prevent the formation of an undesirable pad.

In a further embodiment the spring is pulled back by means of a temporarily excitable stationary magnet to relieve the body for a short while or to totally lift it from the surface such that impurities are conveyed away.

A lifting member and/or stripper member rotating with the roller may influence the yarn under certain operation conditions. It could cause e.g. a pulsation of the yarn tension or the yarn itself. In order to avoid such effects, a smooth yarn contact portion may be provided where the lifting and/or stripper member does not become active for the yarn. A sufficiently effective cleaning effect nevertheless occurs, as in the impurities, particularly fiber materials, a physical and mechanical bonding effect is present by which the stripper member when only partially engaging at a fiber collection will nevertheless carry away such impurities from the contact area.

It is of particular importance for the invention that the applicator has an onboard or integrated cleaning device which is at least periodically active during the operation of the applicator and which carries away impurities which tend to collect in the critical entrance of the contact area between the applicator element and the transfer member. This is expediently done by a stripper member and/or a lifting member rotating with the applicator roller to carry away impurities during each revolution of the roller and to lift the transfer member from the applicator element for an easy removal of the impurities. Due to the active influence of the cleaning device the applicator operates with continuous and precisely adjustable consumption of the impregnation agent. The yarn is impregnated very uniformly and economically. This also results in a low maintenance frequency for refilling the applicator. The formation of a large absorbing impurity and yarn material pad is suppressed by preventively and periodically removing small impurity depositions.

IN THE DRAWINGS

Figure 2:
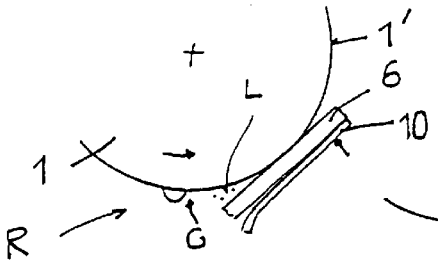
Figure 3:
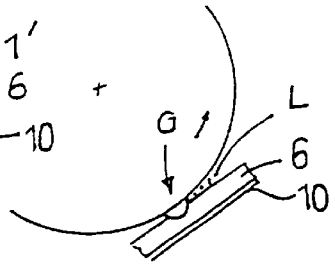
Figure 4:
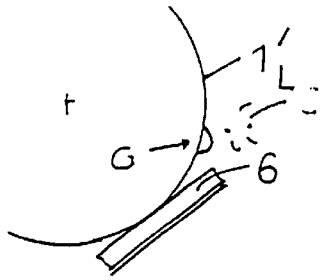
Figure 5:
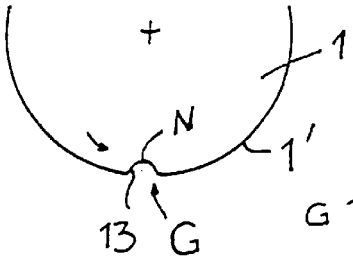
Figure 6:
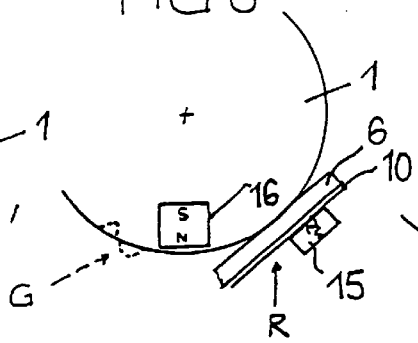
Figure 7:
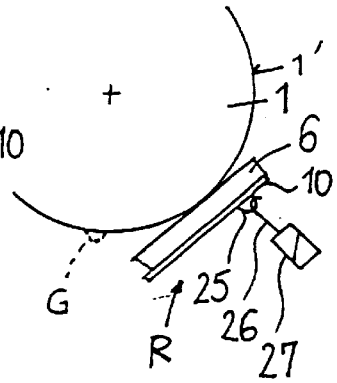
Figure 8:
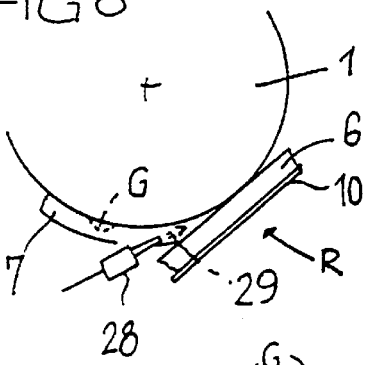
Figure 9:
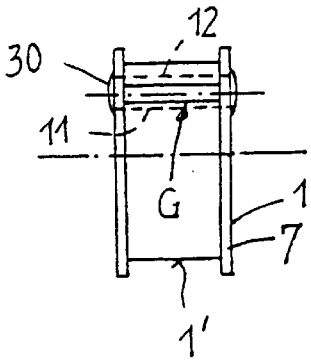
Figure 10:
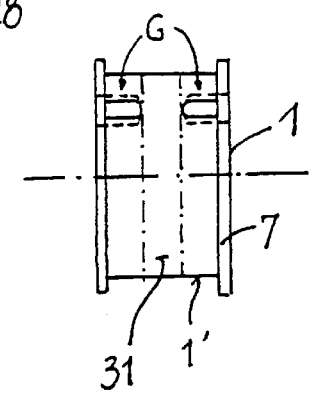

Embodiments of the subject of the invention will be explained with the help of the drawings, of which:

FIG. 1 is a vertical section of an applicator mounted at a yarn feeding device, the applicator being a yarn oiler, FIGS. 2 to 4 show three different operating phases of the applicator of FIG. 1, FIG. 5 is a detail view of a further embodiment, FIG. 6 is a detail view of a further embodiment, FIG. 7 is a detail view of a further embodiment, FIG. 8 is a detail view of a further embodiment, FIG. 9 is a detail front view of the applicator of FIG. 1, and FIG. 10 is a detail view of a variant in a view similar to the view of FIG. 9.

DETAILED DESCRIPTION

An applicator A for applying a liquid impregnation agent 9, e.g. a yarn oiler applying paraffin oil, is, in the embodiment shown in FIG. 1, mounted at the intake side of a yarn feeding device 5. The yarn feeding device 5 pulls yarn from a not shown yarn storage bobbin and feeds the yarn to a not shown textile machine, e.g. a weaving machine (weft yarn). The applicator A instead could be located anywhere along the yarn path or could even be used for other yarn processing apparatus. To secure the applicator A at the yarn feeding device 5, e.g. an apparatus carrier 23 is used. The yarn 2 is running substantially horizontally and passes through the applicator A guided by yarn eyelets 14, 18.

Within applicator A a rotatable applicator element, e.g. a roller 1, is driven by a not shown drive (e.g. an electric gear motor). Said roller 1 may have a substantially smooth, cylindrical surface 1' and edge flanges 7 at both sides. The height position of the applicator element and its motor can be adjusted relative to yarn eyelets 14, 18 (indicated in dash-dotted line, adjustment direction X) to vary the wrapping angle of the yarn. The drive might include a reversible electro-motor for low voltage DC.

Control circuitry 4 for the drive may be received within a housing 3. In the arrangement shown said control circuitry 4 is in signal transmitting connection with a drive control (not shown) of the yarn feeding device 5 such that the rotational speed of the applicator element can be matched with the momentary operating speed (yarn speed) in the yarn feeding device. A cover 20 is provided within housing 3 opposite to a rear wall 21. The applicator element and the yarn feeding device may run in synchronism or with mutual proportionality. The sense of rotation of the applicator in the yarn contacting area may coincide with the yarn running direction (arrow) or opposite to it. For a uniform and intensive impregnation effect it may be expedient to rotate the applicator element counter to the yarn running direction (as indicated in FIG. 1).

A container 19 is provided below the applicator element. The container 19 receives a bath of a liquid impregnation agent 9, e.g. paraffin oil (volume e.g. 450 ccm). A rear wall 22 of container 19 is substantially a continuation of rear wall 21. Within container 19 a top collecting funnel 8 has a passage 24 for a transfer member 6, e.g. a wick, a sponge, a brush, a fabric stripper, a capillary tube or the like. Said transfer member 6 reaches into the impregnation agent 9 in the container 19, extends through passage 24, and contacts surface 1' assisted by an elastic force. The elastic force is generated by a spring element, e.g. a leaf spring 10, supporting the upper end of transfer member 6. In the embodiment shown, collecting funnel 8 supports said leaf spring 10. The transfer member is operating by capillary effects. At rear wall 22 a holding part 17 for a not shown yarn brake may be mounted.

According to the invention the applicator A has at least one onboard or integrated cleaning device R which is activated during any operation of the applicator A. The cleaning device R serves to clean the gusset at the contact area between the transfer member 6 and the applicator element from deposited impurities L. During operation of the applicator A dust particles, fiber parts and other impurities included in the film of the impregnation agent on the surface 1' are wiped off from surface 1' by transfer member 6 and tend to grow there. In addition, there is free flying lint unavoidably occurring at such yarn processing devices tending to also stick and collect particularly in the above-mentioned contact area.

In FIG. 1 cleaning device R comprises a member G which is a stripper member, a lifting member, or a stripper and/or lifting member, respectively, and which is structurally integrated into the applicator element, i.e. into roller 1. During each full revolution, e.g. in a counterclockwise direction of roller 1 said member G moves once through the contact area, strips over the transfer member 6 and lifts or relieves the transfer member 6 and even leaf spring 10 temporarily from surface 1'. Said member G may be a rod, e.g. a pin or a tube 11 (see FIG. 9), and is inserted into a depression 12 of roller 1 such that it protrudes at least with a part of its periphery beyond surface 1'. During the passage of member G through the contact area any deposited impurities L are carried away regularly and are removed such that they are unable to form into an absorbing bigger pad of fibers and impurities at the entrance into the contact area which would increase the consumption of impregnation agent in an uncontrolled and increasing fashion and also could jeopardise the intended transfer effect of transfer member 6, respectively. After said impurities L have been removed from the contact area they fall away, e.g. by centrifugal forces, such that they are of no further harm.

In FIGS. 1 and 9 the pin is oriented substantially parallel to the axis of roller 1. The pin is received in a depression 12 of roller 1 which depression may be formed by an axial bore. The bore expediently also penetrates flanges 7 such that the ends of member G (indicated at 30) may be secured by riveting. Other securing principles for the pin or the tube 11 (clamping, press-fit, gluing) are possible. Roller 1 is made from e.g. light metal and has its surface 1' polished. The pin or the tube 11 may be made from steel. With the given diameter of about 30 mm of surface 1' and a diameter of pin or tube 11 of about 2.5 mm the periphery of said pin e.g. protrudes by a little more than 1 mm beyond surface 1'. The width of surface 1' is e.g. 11 mm while each flange 7 may have a thickness of about 1.5 mm. Several members G can be distributed around the circumference of surface 1', alternatively. Instead of an inserted pin or tube 11 a lateral rib could be formed in surface 1'. The lateral rib or pin or tube 11 need not be parallel to the axis of roller 1 but could be oriented obliquely or could be chevron-shaped. A round peripheral contour of the pin or tube 11 as shown in FIG. 1 is not a must; the contour also could have edges or could be not round.

The function of the cleaning device R with roller 1 rotating counterclockwise is described referring to FIGS. 2 to 4. In FIG. 2 impurities L tend to collect at the entrance or gusset to the contact area. Due to the elastic contact between the transfer member 6 and the roller 1 resulting from the force of leaf spring 10 said impurities L are unable to pass through the contact area. Now the stripper member G is approaching said area. In FIG. 3 stripper member G is already engaging at the impurities L and is conveying them along the surface of said transfer member 6 and through the contact area. Simultaneously, the transfer member 6, which may be elastic, is compressed or even is lifted from roller 1 in the contact area. It may be that even the leaf spring 10 is pushed away. In FIG. 4 stripper member G is past the contact area and has thrown away the impurities L. Transfer member 6 is returned to surface 1'. The stripper and/or lifting effect is independent from the sense of rotation of roller 1.

In FIG. 5 stripper member G is defined by an edge section 13 of a depression N formed into surface 1', e.g. a rounded groove. The somewhat elastic and compacted impurities L momentarily expand into said depression N. Said expansion allows the edge section 13 to grip the impurities L, convey them further through the contact area, and simultaneously strips the surface of transfer member 6 clean. Expediently said edge region 13 may be rounded such that it has less friction influence on the yarn 2.

In FIG. 6 a magnet assembly is provided within the cleaning device R. Said magnet assembly forms a lifting member to temporarily lift the transfer member 6 and even its leaf spring 10. A permanent magnet 16 is imbedded into roller 1. The leaf spring 10 even by itself may form a counter magnet or carries a counter magnet 15, respectively. The polarization of both magnets are opposite such that the magnets when registering repel each other. The momentary repelling effect during the rotation of roller 1 lifts leaf spring 10 for a short while such that impurities collected at the entrance of the contact area are removed by bonding to the wetted surface 1'. Dotted lines indicate that the magnet assembly of the cleaning device R may be combined with the stripper member and/or lifting member G protruding beyond surface 1' and/or a groove N corresponding to FIG. 5. With said structural combination not only the cleaning effect is intensified but also the mechanical load on the transfer member 6 decreases as the magnetic forces assist the lifting member.

In FIG. 7 a lifting magnet 27 is provided in cleaning device R. Said lifting magnet 27 by means of pulling element 26 engages at a retainer 25 of leaf spring 10 to temporarily pull the leaf spring 10 in response to a control command from surface 1' such that impurities collected at the entrance of the contact area are removed as they stick to the wetted surface 1'. In place of lifting magnet 27 another drive system (mechanical, pneumatic, piezo-electrical, or the like) may be used. Said device for lifting at least said leaf spring 10 may be combined with a lifting and/or stripper member G provided at roller 1.

In FIG. 8 cleaning device R has e.g. at least one air nozzle 28 directing a forceful air jet or single pulsating air jet impacts 21 into the gusset area at the entrance of the contact area to force collected impurities L through the contact area and to at least temporarily lift transfer member 6. Said air nozzle 28 expediently is connected to a not shown control system (e.g. a solenoid valve) to control cleaning cycles in predetermined points in time (adjusted regularly or irregularly). In this case flanges 7 form lateral boundaries of surface 1' such that the air cannot escape sidewards. The cleaning effect of air nozzle 28 alone may be sufficient, however, it even can be expedient to combine an air nozzle 28 with at least 1 stripper and/or lifting member G (indicated in dotted lines).

In FIG. 10 a smooth yarn contacting portion 31 is provided on surface 1' of roller 1. This means that the stripper and/or lifting member G extends only at one or at both sides of yarn contacting portion 31. The cleaning effect achieved by the design is sufficient since the collected impurities at the deposition location internally stick together and can be efficiently torn away if they are frictionally engaged only outside of smooth yarn contacting portion 31 by member G.

In a not shown embodiment a stripper and/or lifting member may be provided separately from roller 1 and may be periodically driven by its own drive device during the operation of the applicator to then move through the contact area and to carry away collected impurities.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An applicator for applying a liquid impregnation agent to running yarns, said applicator comprising a roller, an elastic wick body which is held by an elastic force in tangential contact with a surface of said roller and conveys impregnation agent thereto by capillary effect, and an onboard or integrated cleaning device for removing impurities collecting between said body and said roller, said cleaning device being activated during operation of said applicator and including at least one driven stripper member which is periodically brought into engagement with the impurities and said body.

2. The applicator of claim 1 wherein said stripper member comprises at least one generally rib-shaped projection disposed on said roller and protruding beyond said surface thereof.

3. The applicator of claim 2 wherein said projection comprises a rod-shaped body embedded into said surface of said roller such that a periphery of said rod-shaped body protrudes beyond said surface, said rod-shaped body being substantially parallel to a rotational axis of said roller and being rotatable along with said roller.

4. The applicator of claim 3 wherein said rod-shaped body comprises a pin or a tube.

5. The applicator of claim 2 wherein said surface of said roller defines thereon a smooth yarn contact portion and said projection is disposed on one side of said yarn contact portion.

6. The applicator of claim 5 wherein said stripper member comprises a pair of said projections, said projections being laterally spaced from one another on opposite sides of said contact portion.

7. The applicator of claim 1 wherein said surface of said roller defines therein a depression, and said stripper member comprises an edge portion of said depression.

8. The applicator of claim 1 wherein said stripper member is disposed to lift said body away from said surface of said roller to so as to remove the impurities collecting between said body and said roller.

9. An applicator for applying a liquid impregnation agent to running yarns, said applicator comprising a rotatable applicator element, an impregnation agent transfer member which contacts a surface of said applicator element, and an integrated cleaning arrangement which is active during operation of said applicator, said cleaning arrangement including a lifting device disposed to temporarily lift said transfer member away from said surface of said applicator element to remove impurities collecting between said transfer member and said applicator element.

10. The applicator of claim 9 wherein said cleaning arrangement includes a spring disposed to bias said transfer member into contact with said surface of said applicator element, and said lifting device temporarily lifts said transfer member away from said surface against the biasing force of said spring.

11. The applicator of claim 10 wherein said lifting device includes a magnet disposed within said applicator element and rotatable therewith, and said spring is itself a counter-magnet by being constructed of magnetic material or carries a counter-magnet, and the polarizations of said magnet and said counter-magnet being selected such that said spring is pushed away from said surface upon movement of said magnet carried by said applicator element past said counter-magnet.

12. The applicator of claim 10 wherein said lifting device includes a stationary magnet disposed generally adjacent said spring, and said spring is itself a counter-magnet by being constructed of magnetic material or carries a counter-magnet, said stationary magnet being temporarily excitable during rotation of said applicator element so as to magnetically pull said spring away from said surface.

13. The applicator of claim 9 wherein said lifting device includes an air nozzle disposed to direct an air jet at the entrance of a contact area defined between said applicator element and said transfer member to force the impurities through said contact area and temporarily lift said transfer member away from said applicator element.

14. The applicator of claim 9 wherein said lifting device comprises a projection which protrudes beyond said surface of said applicator element and is carried on said applicator element for rotation therewith.

15. The applicator of claim 9 wherein said lifting device is carried on said applicator element for rotation therewith such that said applicator element serves as a rotational drive for said lifting device.

16. The applicator of claim 9 wherein said lifting device includes its own drive arrangement.

17. The applicator of claim 9 wherein one of: a pneumatic drive arrangement; an electrical drive arrangement; and an electromagnetic drive arrangement is provided to drive said lifting device.

18. An applicator for applying a liquid impregnation agent to running yarns, said applicator comprising a rotatable applicator element, an impregnation agent transfer member which contacts a surface of said applicator element, and a cleaning member which is active during operation of said applicator and rotatable with said applicator element to remove impurities collecting between said transfer member and said applicator element.

19. The applicator of claim 18 wherein said cleaning member is configured so as to lift said transfer member away from said surface of said applicator element to allow ready removal of the impurities.

20. The applicator of claim 18 wherein said applicator element comprises a roller and said transfer member comprises a wick which conveys the impregnation agent from a supply to said surface of said roller.

21. The applicator of claim 20 wherein said wick is biased into contact with said surface of said roller, said cleaning member comprises a protrusion defined on said surface of said roller and rotating with said roller, and during each revolution of said roller, upon reaching the location of said wick, said protrusion lifts said wick away from said surface of said roller and conveys the impurities along said surface and through a contact area defined between said wick and said surface.

22. The applicator of claim 20 wherein said wick is biased into contact with said surface of said roller, said cleaning member comprises an edge of a depression defined in said surface of said roller and rotating with said roller, and during each revolution of said roller, upon reaching the location of said wick, said edge conveys the impurities along said surface and through a contact area defined between said wick and said surface.

23. The applicator of claim 18 wherein said cleaning member rotates with said applicator element to carry away impurities during each revolution of said applicator element.

* * * * *